US005167575A

United States Patent [19]

MacDonald

[11] Patent Number: 5,167,575

[45] Date of Patent: Dec. 1, 1992

[54] CLEAN ROOM INCLUDING AN INTERNAL PARTITION SYSTEM

[76] Inventor: Ross P. MacDonald, 2630 NW. Robinia La., Portland, Oreg. 97229

[21] Appl. No.: 397,716

[22] Filed: Aug. 23, 1989

[51] Int. Cl.[5] ..... F24F 13/068

[52] U.S. Cl. ..... 454/187; 52/71

[58] Field of Search ..... 52/71; 98/29, 31.5, 98/31.6, 33.1, 34.5, 34.6, 36; 160/135

[56] References Cited

U.S. PATENT DOCUMENTS

| | | | |
|---|---|---|---|
| 756,091 | 3/1904 | Altick | 52/71 X |
| 2,162,523 | 6/1939 | Blood et al. | 52/71 X |
| 3,107,400 | 10/1963 | Anderson | 52/71 X |
| 3,387,413 | 6/1968 | Huey | 52/71 X |
| 4,037,385 | 7/1968 | Wahlquist | 52/71 X |
| 4,608,066 | 8/1986 | Cadwell, Jr. | 98/31.5 X |
| 4,726,154 | 2/1988 | Raptis et al. | 52/69 X |

FOREIGN PATENT DOCUMENTS 1589950 5/1981 United Kingdom ..... 52/71

*Primary Examiner*—Harold Joyce

*Attorney, Agent, or Firm*—Marger, Johnson, McCollom & Stolowitz, Inc.

[57] ABSTRACT

This invention relates to operable partition systems for internally partitioning clean room areas into various work area configurations without the need for substantial manual operations. The operable, internally-partitionable clean room includes internal partitions which can be moved to a plurality of predetermined sites for physically, environmentally or visually separating the working area. This permits the user to easily provide the requisite level of work area separation. The internal partition system may be automatically operated. The partition system may be stored at one or more locations within the clean room when not in use. The operable partition system may include a track and carrier assembly for moving the internal partitions into place, typically an overhead track and carrier assembly.

12 Claims, 3 Drawing Sheets

CLEAN ROOM INCLUDING AN INTERNAL PARTITION SYSTEM

BACKGROUND OF THE INVENTION

Clean rooms are areas defined within an exterior wall arrangement in which conditions such as temperature, humidity and airborne particulate contamination are closely controlled in order for workers to be able to perform certain environmentally-sensitive job functions. Examples of environmentally-sensitive industrial applications for which clean rooms are employed include handling of aerospace fluids in the aerospace industry, or materials in the pharmaceutical and biochemical industries, or microchips in the computer industry (see ASTM F318-78). The use of an effective and efficient clean room can significantly reduce the risk of contamination of these products and result in higher production yields and therefore higher profits.

Various known clean room systems can include partitions disposed within the interior of their exterior wall arrangement. All of these prior art internal partitions are installed in a fixed location. If they are relocated to other sites within the clean room, or if they are to be removed and stored away, such relocation or storage operations must be done by manually disassembling and carrying the component pieces of the partitions for reassembly upon relocation of the partitions. Examples of the above known fixed location clean room systems includes systems manufactured by Donn Corporation of Westlake, Ohio, which comprises a fixed, external panel-to-stud partition assembly for minimizing air passage and maintaining positive clean room pressure. Another clean room partition manufacturer for the aerospace and computer industries is Unistrut Corporation of Ann Arbor, Mich. In the Unistrut system, panels are fastened to fixed Unistrut framing to provide a positive seal while leaving a clean, ledge-free room wall seal.

SUMMARY OF THE INVENTION

Applicant has determined that fixed wall internal partitions in a clean room environment are limiting because of the difficulty encountered by users in manually carrying the partition components to various points within the clean room for purposes of relocating and storing same. This is a particular problem if relocation has to be done on a frequent basis. Accordingly, applicant has found that a need exists for a clean room having a system for internally operably partitioning same which does not require such manual carrying operations and which is clean room compatible, i.e., does not add to the particulate level in the clean room working area. The subject operable partitions are engineered for specific end use requirements and are fabricated using clean room compatible materials. In this way, the amount of contamination, particularly airborne particulate contamination, can be controlled and minimized. These partition systems of the present invention provide for a more flexible, effective and efficient physical, environmental and visual separation of an internal clean room space.

This invention relates to operable partition systems for internally partitioning clean room areas and thereby providing the above-described physical, environmental or visual separation without the need for substantial undesirable manual operations. An operable, internally-partitionable clean room typically comprises a clean room having external wall means defining an internal working area in which environmental conditions are substantially controlled and operable partition means made of clean room compatible materials which will not substantially increase the air particulate level in the internal working area. This will permit workers to perform the required activities within a working area which can be easily re-configured by operably rearranging the partition means. The partition means employed in the systems of the present invention can be operably relocated to form numerous structural use configurations, or can be operably moved to a desired storage location when not in use.

The partition means are locatable within the internal working area of a clean room for physically, environmentally or visually separating the working area, and including means for operably locating the partition means at a plurality of sites within the working area. The operable, internally-partitionable clean room of this invention preferably includes means for operably locating the operable partition means to a plurality of predetermined sites for physically, environmentally or visually separating the working area. This permits the user to more easily provide the requisite level of work area separation in a easily replicable manner. It can also include means for automatically controlling the step of operably locating the operable partition means to a plurality of sites for physically, environmentally or visually separating the working area. The operable, internally-partitionable clean room may also include means for operably storing the operable partition means, when not in use as a separation means, within the internal working area, preferably for operably storing the operable partition means at a plurality of predetermined storage sites.

This means for operably locating the operable partition means generally comprises a track and carrier assembly, typically an overhead track and carrier assembly. An overhead track and carrier assembly eliminates the need for floor tracks which accumulate undesirable particulate material. The partition means preferably includes ventilation means which provides a passage for moving air through the partition means within the internal work area and thereby facilitating the removal of particulate material from the air by the clean room filtration system.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
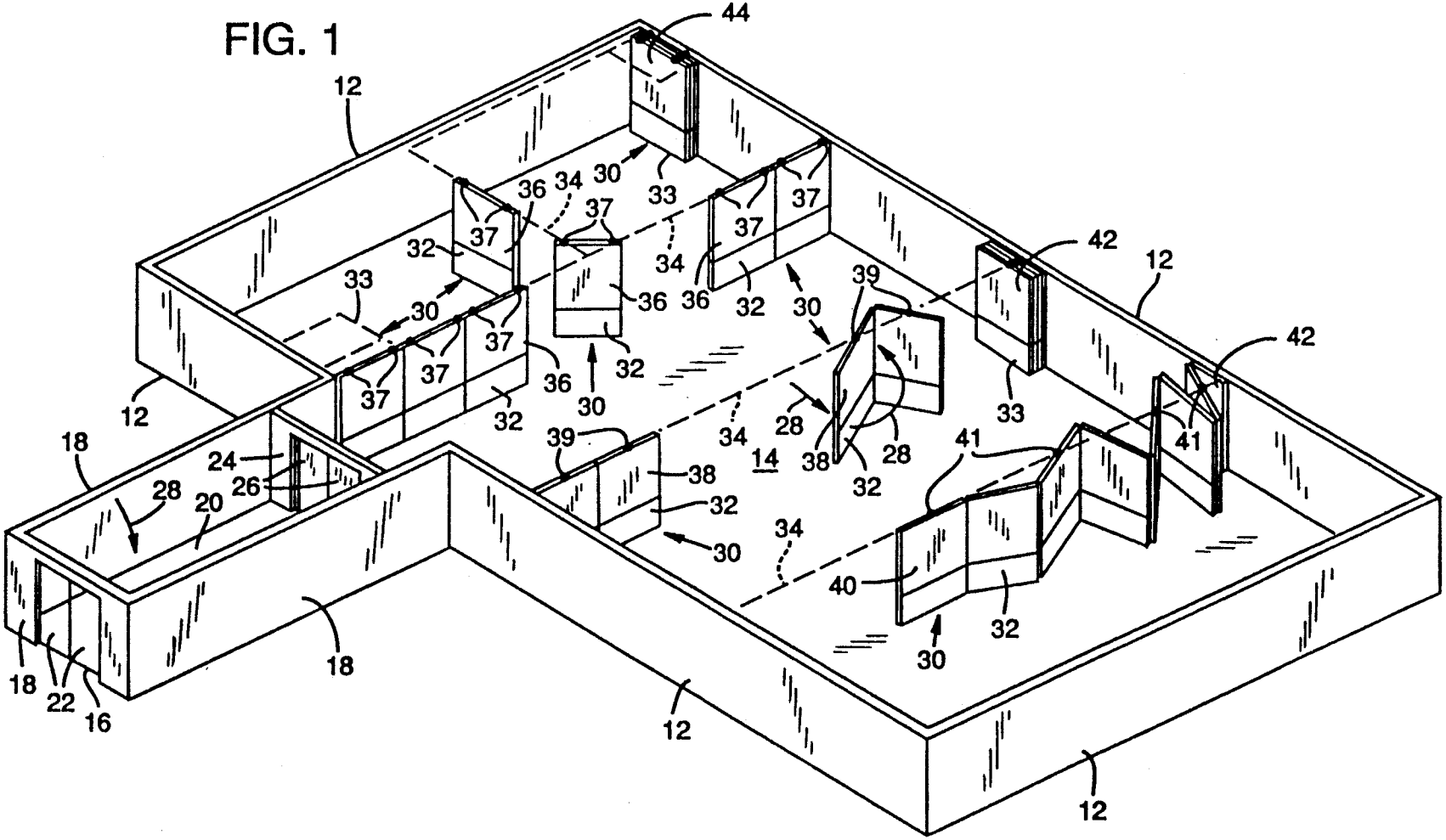
FIG. 1 is a perspective schematic representation of a clean room including various illustrative internal partition systems.

Referring now to FIG. 1, a clean room 10 including various illustrative internal operable partition systems 30 is shown. Clean room 10 comprises external walls 12 which define an interior working area 13 in which environmental conditions are substantially controlled as previously described. The clean room activities are conducted on interior floor 14. In order that the proper clean room conditions are maintained, a decontamination entry compartment 16 is provided. The compartment 16 comprises exterior walls 18 and an interior floor 20. A pair of outer automatic entry doors are employed which open laterally when a clean room worker enters the clean room 10 and close behind him. The worker is then subjected to decontamination in which a stream of decontaminating air passes through compartment 16 and reduces the contaminant level of the worker located therewithin to an acceptable point for entry into the interior working area 13. The compartment 16 is separated from working area 13 by inner entry walls 24 and inner automatic entry doors 26. The doors 26 then move laterally apart, and the worker enters the working area 13.

The contaminant level in working area 13 is maintained below a predetermined level by introducing streams of air, as indicated by arrows 28, into working area 13 for continuously removing undesirable contaminants therefrom and passing the contaminated air through a filtration system (not shown). This filtration system can also be used to remove contaminants from the air in compartment 16. Typical filtration systems which can be employed for the above-described contaminant removal purposes are manufactured by Daw Technologies of Salt Lake City, Utah, by Linear-Flo of Skokie, Ill., and by Laminarie Corporation of Rahway, N.J.

Illustratively shown within working area 13 of clean room 10 are there different types of operable partition systems: (a) multi-directional single partition system 36, (b) hinged-pair partition system 38, and (c) continuously-hinged partition system 40. In use, partitions 32 can travel in the following operable travel paths 34: System (a) is multi-directional and can be moved in, for example, a straight, radius-curved, or right angle path of travel, while Systems (b) and (c) are bi-directional and are movable in a straight-line path of travel only.

Figure 4:
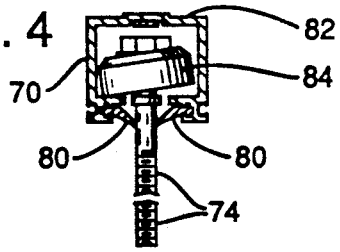
FIG. 4 is an enlarged, sectional end view of alternative multi-directional trolley assembly 82.

System 36 comprises single partitions connected to a track assembly at both ends, at connection point 37, using a pair of multi-directional trolley assemblies 82 (see FIG. 4). The path of travel 34 of partitions 32 in use for system 36 is illustratively depicted at right angles. Partitions 33 are shown in the stored position known as a parallel side stack 44. It is also shown in phantom stored in a perpendicular stacking a corner on interior floor 14.

Figure 3:
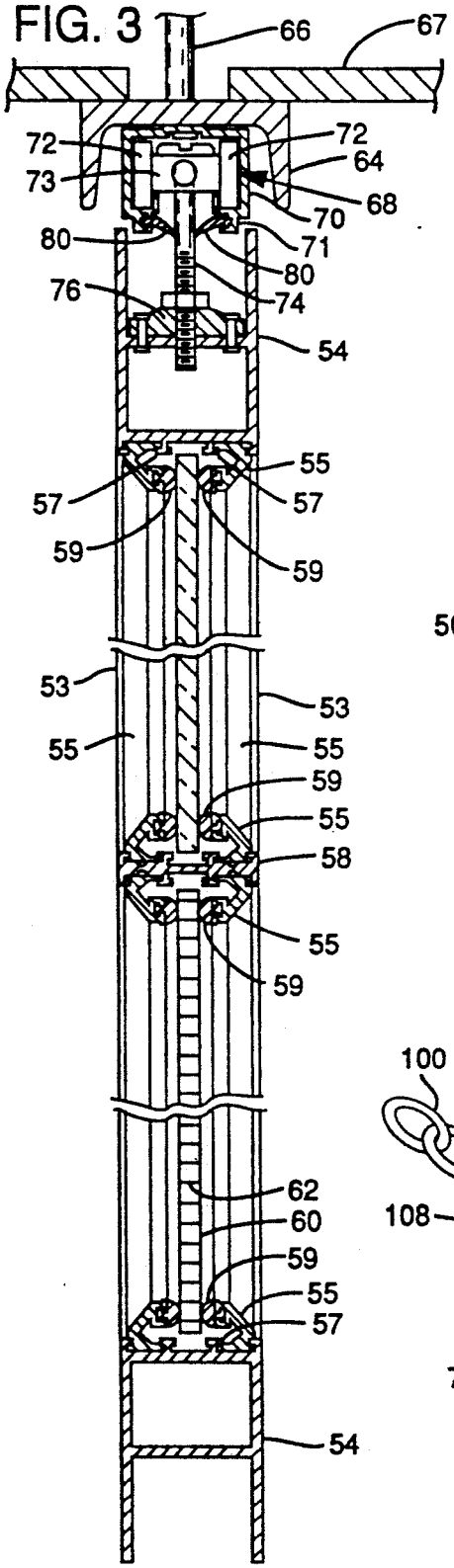
FIG. 3 is an enlarged, sectional end view of the clean room partition of FIG. 2 connected for operation to ceiling panel 67 by unidirectional trolley assembly 66.

System 38 comprises pairs of partitions hinged together and connected in the center of each partition, at connection point 39, using a unidirectional trolley assembly 68 (see FIG. 3). The path of travel 34 of partitions 32 in use for system 38 is in a straight-line path. Partitions 33 are shown in the stored position known as a centerline stack 42.

System 40 comprises continuously hinged partitions 32 connected to a track assembly in the center of alternate partitions, at connection point 41, using bi-directional trolley assembly 68. The path of travel 34 of partitions 32 in use for system 40 is in a straight-line path. Partitions 33 are also shown in the stored position know as a centerline stack 42. However, unlike systems 36 and 38 which are operably and manually moved by the user, system 40 can also be automatically moved by the user from a completely extended to a completely stored position. A typical manner of conducting such movement will be hereinafter set forth.

Figure 2:
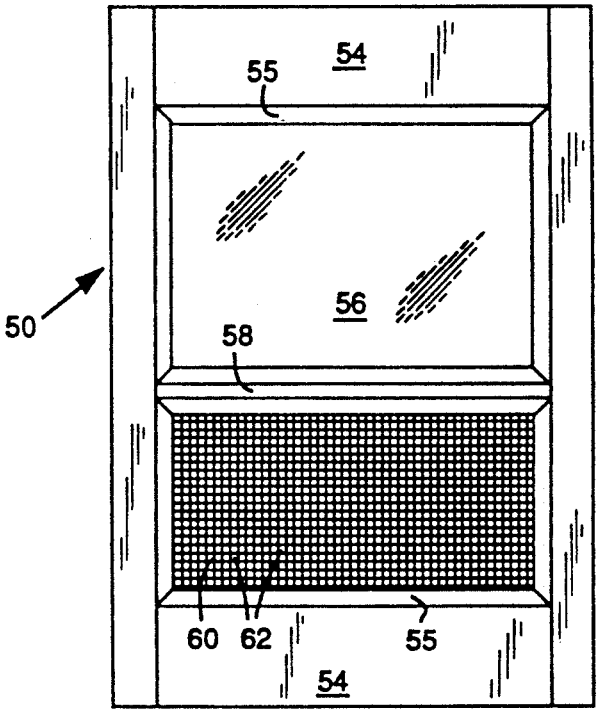
FIG. 2 is an enlarged elevational view of a clean room partition.

A preferred clean room partition 50 which can be employed as part of the operable partitions systems of this invention is shown in FIGS. 2 and 3. Partition 50 is made of clean room compatible materials which will not substantially increase the air particulate level within interior working area 13. Partition 50 comprises a partition frame 62 including vertical frame portion 53 and horizontal frame portion 54 joined one to the other which are preferably constructed of anodized aluminum, a clean room compatible material. The frame 52 is connected to upper vision panel 56, which is typically ¼"-178" thick, and can be fabricated of glass or plexiglas. Lower ventilation panel 60 is generally formed of a plastic egg-crate material including ventilation airflow slot 62. Both the vision panel 56 and the ventilation panel 60 are made of clean room compatible materials. An exemplary egg-crate material is manufactured by American Louver of City of Commerce, Calif. The vision panel permits the worker to view activities in other parts of clean room 10. The ventilation panel 60 provides a passage for moving air through the partition 50 and thereby facilitating the removal of particulate material by the clean room filtration system. In this way, the low particulate level required in clean rooms can be maintained. The respective panels 56 and 60 are held in place at their respective ends by gasket 59-snap-in stop trim 55 arrangements. At the top of panel 56 and the bottom of panel 60 the other end of the gasket 59 snap-in stop trim 55 arrangements are connected to fingers 57 of frame members 53 and 54, respectively. The bottom of panel 56 and the top of panel 60 are each connected by a gasket 59-snap-in stop trim 55 arrangement to a horizontal mullion 58.

Figure 7:
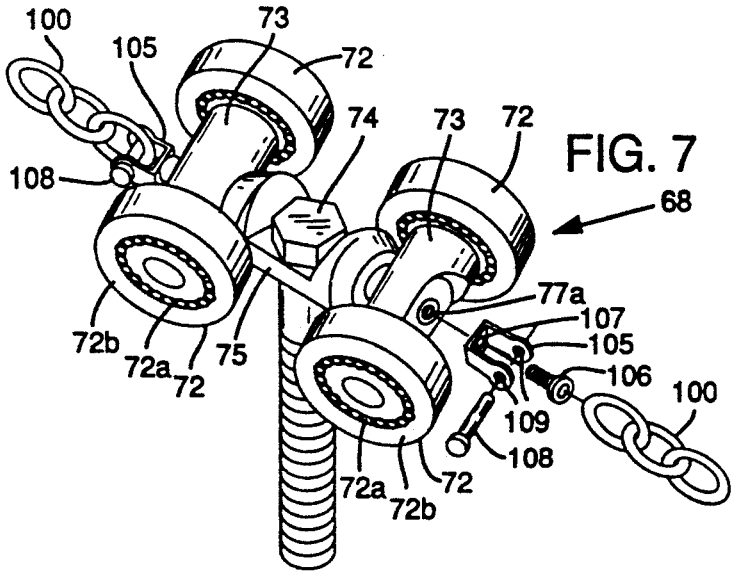
FIG. 7 is a perspective view of trolley assembly 68.
Figure 6:
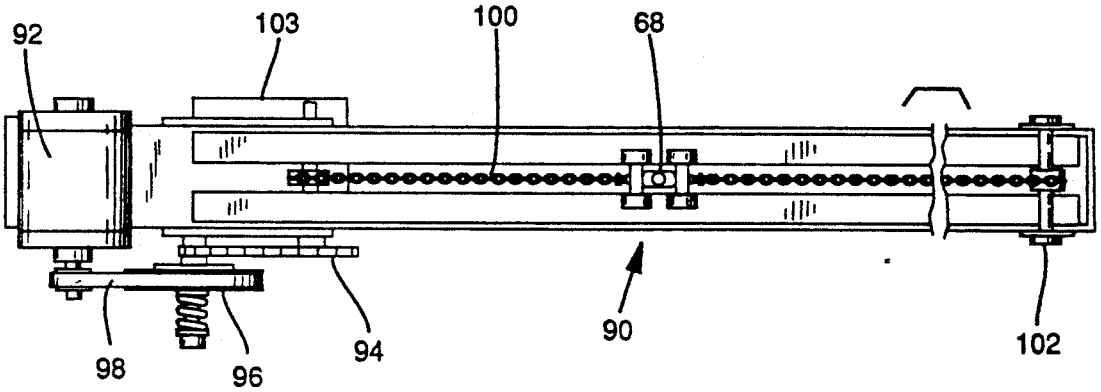
FIG. 6 is a top view of the system of FIG. 5.
Figure 5:
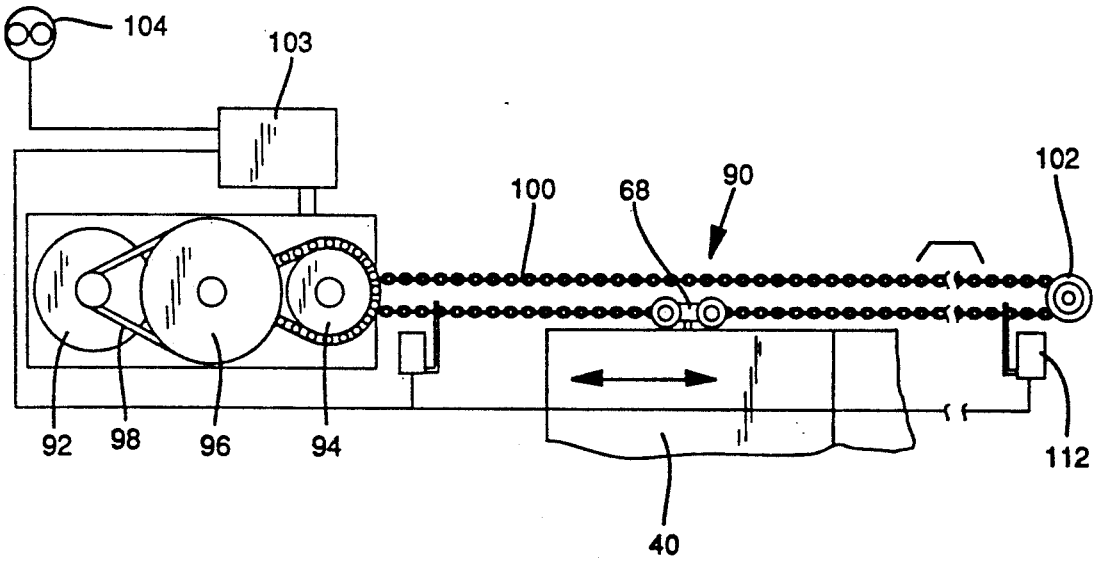
FIG. 5 is an enlarged, sectional schematic view of a system for the automated operation of continuously-hinged internal partition system 40.

As best seen in FIGS. 3 and 4, partition 50 is connected overhead to a header or other support system (now shown) capable of supporting the weight of the partition 50 and the associated operable moving equipment. As shown in FIG. 3, attachment is made through ceiling panel 67. More specifically, trolley assembly 68 is connected to the ceiling structure (not shown) by overhead attachment assembly 66 passing through an aperture in structural channel 64. Trolley assembly 68 bi-directionally ridges within track assembly 70 on U-shaped track means 71. The trolley assembly 68 includes two pairs of wheel 72. Each pair of wheels is attached to one of a pair of dual wheel axle assemblies 73. The assemblies 73 are attached one to the other by axle connecting assembly 75. The respective assemblies 73 and 75 are held in place by bolt 106. Chain bracket members 105 are attached to threaded ends 77*a* by bolts 106 passing through apertures 107 (see FIG. 7). A pin 108 is joined to each bracket member 105 within apertures 109. Continuous loop chain 100 of FIGS. 5 and 6 is connected to bracket member 105 via pin 108 for moving trolley assembly 68, and in turn, partition 40. The wheels preferably comprise a roller bearing hub assembly 72*a* having a nylon outer tire 72*b* thereabout. The axle connecting assembly 75 has an aperture therewith through which a pendant bolt 74 passes. A trolley plate 76 is joined to horizontal frame portion 54 and is connected to trolley assembly 68 by pendant bolt 74. Flexible protective strips 80 are attached within U-shaped track means 71 and against pendant bolt 74. In an alternative form of the above invention, FIG. 4 depicts a multi-directional trolley assembly. The major difference between the respective multi-directional and bi-directional trolley assemblies is the use of a rotating canted wheel 84, which permits multi-directional or bi-directional movement of the trolley assembly, in place of the wheel-axle assembly described above, which only permits bi-directional movement.

FIGS. 5 and 6 show a system for the automated operation of continuously-hinged internal partition system 40. More specifically, continuously-hinged partition system 40 moves between extended and stored positions. In the extended position, partition 40 is moved by trolley assembly 68 and continuous loop chain 100 until it is detected by first limit switch 110 and the partition is stopped by disconnecting the power to the motor controls 103 until the opposite position of travel occurs. Movement of the partition 40 is powered by reversible electrical motor 92 which supplies the proper engineered horsepower to a reduction gear assembly 94. Assembly 94 regulates the speed and torque imparted to the trolley assembly 68 through a friction clutch assembly 96 which allows for mid cycle drive interruption without damage to the drive system. Power is then applied to the continuous loop chain 100 with return sprocket and chain tightener 102 connected to the trolley assembly 68 by chain bracket member 105 as previously described. In the stored position, partition 40 is moved by continuous loop chain 100 until it is detected by second limit switch 112, and the partition 40 is stopped. All motor functions are controlled by position operation stations 104, which may be reduced voltage by means of a step-down power transformer (not shown) located in the control box 103.

Having illustrated and described the participles of my invention in a preferred embodiment thereof, it should be readily apparent to those skilled in the art that the invention can be modified in arrangement and detail without departing from such principles. I claim all modifications coming with the spirit and scope of the accompanying claims.

I claim:

1. An operable, internally-partitionable clean room, which comprises:

a clean room comprising an external wall means defining an internal working area in which environmental conditions are substantially controlled; and operable partition means made of clean room compatible materials which will not substantially increase the air particulate level in said internal working area, said partition means being locatable within said internal working area for physically, environmentally or visually separating said working area, and including means for operably locating said partition means at a plurality of sites within said working area;

said operable, internally-partitionable clean room includes means for operably locating said operable partition means to a plurality of predetermined sites for physically, environmentally or visually separating said working area, and means for automatically controlling said operable locating of said operable partition means to said plurality of sites for physically, environmentally or visually separating said working area.

2. The operable, internally-partitionable clean room of claim 1, wherein said operable, internally-partitionable clean room includes means for operably storing said operable partition means, when not in use as a separation means, within said internal working area.

3. The operable, internally-partitionable clean room of claim 2, wherein said operable, internally-partitionable clean room includes means for operably storing said operable partition means at a plurality of predetermined storage sites.

4. The operable, internally-partitionable clean room of claim 1, wherein said means for operably locating said operable partition means comprises a track and carrier assembly.

5. The operable, internally-partitionable clean room of claim 4, wherein said means for operably locating said operable partition means comprises an overhead track and carrier assembly.

6. The operable, internally-partitionable clean room of claim 1, wherein said partition means further includes ventilation means for providing a passage for moving air through said partition means within the internal work area and thereby facilitating the removal of particulate material from the air by the clean room filtration system.

7. A method for internally-partitioning a clean room, which comprises:

providing a clean room comprising external wall means defining an internal working area in which environmental conditions are substantially controlled; and providing within said internal working area an operable partition means made of clean room compatible materials for internally partitioning said clean room;

operably locating said partition means within said working area to a plurality of predetermined sites and automatically controlling said operable locating of said operable partition means to said plurality of sites for either physically, environmentally or visually separating the working area.

8. The method of claim 7, which further includes the step of storing said operable partition means, when not in use as a separation means, within said internal working area.

9. The method of claim 8, which further includes the step of operably storing said operable partition means at a plurality of predetermined storage sites.

10. The method of claim 7, wherein said step of operably locating said operable partition means comprises moving said operable partition means within said working area by a track and carrier assembly.

11. The method of claim 7, wherein said step of operably locating said operable partition means comprises moving said operable partition means within said working area by an overhead track and carrier assembly.

12. The method of claim 7, which further includes the step of providing a ventilation means within said partition means including air flow passage means, moving air through said partition means within the internal work area and thereby facilitating the removal of particulate material from the air by the clean room filtration system.

* * * * *

UNITED STATES PATENT AND TRADEMARK OFFICE

CERTIFICATE OF CORRECTION

PATENT NO. : 5,167,575

DATED : December 1, 1992

INVENTOR(S) : Ross P. MacDonald

It is certified that error appears in the above-indentified patent and that said Letters Patent is hereby corrected as shown below:

| | |
|---|---|
| Cover page, Item [56] | References Cited, line 5, change "7/1968 Wahlquist" to --7/1977 Wahlquist--; |
| Column 3 | Line 39, change "there" to --three--; |
| Column 3 | Line 55, change "stacking" to --stack in--; |
| Column 4 | Lline 15, change "62" to --52--; |
| Column 4 | Line 20, change "178" to --1/2"--; |
| Column 4 | Line 44, change "now" to --not--; |

UNITED STATES PATENT AND TRADEMARK OFFICE

CERTIFICATE OF CORRECTION

PATENT NO. : 5,167,575
DATED : December 1, 1992
INVENTOR(S) : Ross P. MacDonald

It is certified that error appears in the above-indentified patent and that said Letters Patent is hereby corrected as shown below:

| | |
|---|---|
| Column 4 | Line 51, change "ridges" to --rides--; |
| Column 4 | Lines 66-67, change "therewith" to --therewithin--; |
| Column 5 | Line 43, change "with" to --within--. |

Signed and Sealed this

Twenty-second Day of March, 1994

Bruce Lehman

*Attest:*

BRUCE LEHMAN

*Attesting Officer*

*Commissioner of Patents and Trademarks*